United States Patent [19]

Morris

[11] 4,223,462

[45] Sep. 23, 1980

[54] DIGGING CHAIN SUPPORT FOR EXCAVATION

[75] Inventor: Marvin L. Morris, Wichita, Kans.

[73] Assignee: J. I. Case Company, Racine, Wis.

[21] Appl. No.: 33,454

[22] Filed: Apr. 26, 1979

[51] Int. Cl.[3] ..... E02F 3/14

[52] U.S. Cl. ..... 37/191 A; 30/383; 299/82

[58] Field of Search ..... 37/86, 191 A; 299/82–84, 76; 30/383–387, 381–382; 308/239, 3 R

[56] References Cited

U.S. PATENT DOCUMENTS

| | | | |
|---|---|---|---|
| 2,316,997 | 4/1943 | Smith | 30/385 |
| 2,653,808 | 9/1953 | Simmons | 299/84 |
| 2,811,342 | 10/1957 | McCallum | 299/82 |
| 2,846,786 | 8/1958 | Barber et al. | 37/86 |
| 3,028,693 | 4/1962 | Malzahn | 37/86 A |
| 3,130,506 | 4/1964 | Laster | 37/86 A |
| 3,133,365 | 5/1964 | Davis et al. | 37/86 |
| 3,604,755 | 9/1971 | Krekeler | 299/84 |
| 3,754,341 | 8/1973 | Caldwell et al. | 37/86 |
| 3,754,341 | 8/1973 | Caldwell | 30/383 X |
| 3,856,358 | 12/1974 | Krekeler | 308/239 X |

*Primary Examiner*—Eugene H. Eickholt

*Attorney, Agent, or Firm*—Goldsmith, Shore, Sutker & Milnamow, Ltd. Dressler

[57] ABSTRACT

Excavating apparatus including a boom having an idler pulley on its outer end and adapted to carry a digging chain in sliding arrangement with the boom is provided with skid shoe means and a nose piece which are disposed between the idler pulley and the outer end of the boom for slidably engaging and supporting the digging chain between the idler pulley and the lower surface of the boom. The skid shoe means defines a support surface that is substantially coplanar with the lower surface of the boom to support the links of the chain, and the nose piece has a lower surface generally parallel to the lower surface of the boom and is adapted to engage the digging chain rollers when the links of the chain are engaging the skid shoe means. Both the skid shoe means and the nose piece thus prevent the chain from causing excessive wear on the end of the boom.

5 Claims, 2 Drawing Figures

DIGGING CHAIN SUPPORT FOR EXCAVATION

DIGGING CHAIN SUPPORT FOR EXCAVATION

Description

1. Technical Field

The present invention relates generally to excavating equipment having a boom carrying a digging chain that may be used in mining or to dig ditches. More particularly, the present invention relates to a device for supporting the digging chain carried on a boom in order to avoid excessive wear on the end of the boom.

2. Background of Prior Art

Canadian Pat. No. 1,032,186 issued to Morris discloses a boom arm having a pair of side plates attached to each side of its outer end. Each side plate extends beyond the outer end of the boom and a wear pin is supported beyond the end of the boom between the plates in a fixed and rigid position. This structure contemplates that the chain will be guided by the wear pin in conjunction with wear strips secured on the lower surface of the boom is such a manner that prevents the chain from excessively wearing against the boom. The wear pin is disclosed to be made of especially hard metal material, so that if and when the chain encounters the pin, the chain will not be able to wear the pin. One problem with this structure is that the wear pin provides a relatively small surface, and if the chain encounters the pin to a great extent during digging, then the inner surfaces of the links of the chain may be subject to excessive wear.

Several typical mining and digging machines are disclosed in the following U.S. Pats.: No. 2,561,657 to F. L. Fulke; No. 2,156,732 to O. F. Lewis; No. 2,835,055 to D. J. Itermes; No. 2,817,167 to H. A. Barker; No. 2,811,342 to R. A. McCallum; No. 3,623,246 to R. W. Skomial et al.; No. 3,130,506 to F. H. Laster; No. 2,846,786 to H. A. Barber et al.; No. 3,398,471 to W. D. Brown; No. 2,997,276 to D. J. Davis; No. 3,133,365 to C. J. Davis et al; No. 2,653,808 to L. E. Simmons; and No. 3,856,358 Krekler. These patents are generally illustrative of the state of the art in trench digging machines and cutter chains.

A number of commercially available excavating machines for mining or digging ditches include a boom carrying a digging chain. The chain is typically driven by a sprocket located near or on the inner end of the boom, and may be in sliding engagement with one or both surfaces of the boom. In many cases, the boom is provided at its outer end with an idler pulley to facilitate movement of the chain around the end of the boom without generating excessive wear during digging, while in other cases, the boom is rounded at its outer end.

In each prior art machine having a boom provided with an idler pulley on its outer end, there is a gap between the lower circumferential surface of the idler pulley that guides the chain and the lower part of the outer end of the boom. When these machines are used in digging, the portion of the chain that extends between the lower circumferential surface of the idler pulley and the lower surface of the boom may be forced against the outer end of the boom, causing excessive wear on the boom and, depending on the relative hardness of the metal, on the chain.

SUMMARY OF THE INVENTION

In accordance with the present invention, a boom adapted to carry a digging chain having an idler pulley disposed at or near its outer end is provided with skid shoe means disposed outwardly of the boom for slidably engaging and supporting the side bars or links of the chain between the idler pulley and the lower surface of the boom. The skid shoe means defines a support surface that is substantially coplanar with the lower surface of the boom and which is adapted to engage the links of the chain. In addition, a nose piece is mounted on the outer end of the boom, and has a surface that is generally parallel to the lower surface of the boom and which is adapted to engage the digging chain rollers when the links of the chain are engaging the skid shoe means.

In the illustrated embodiment of the invention, the boom is provided on its outer end with extendable boom end means for adjusting the tension of the chain and absorbing shock during digging. The idler pulley is disposed near the outer end of the extendable boom end means and the skid shoe means are supported underneath the extendable boom end means. The nose piece is disposed on the outer end of the boom in such a manner that the skid shoe means and nose piece support the digging chain along substantially all of the distance between the end of the boom and the idler pulley regardless of the degree to which the extendable boom end means is extended or compressed. In this manner the chain is supported during digging by the skid shoe means and the nose piece, and the lower part of the outer end of the boom is completely protected from excessive wear.

DETAILED DESCRIPTION

Figure 1:
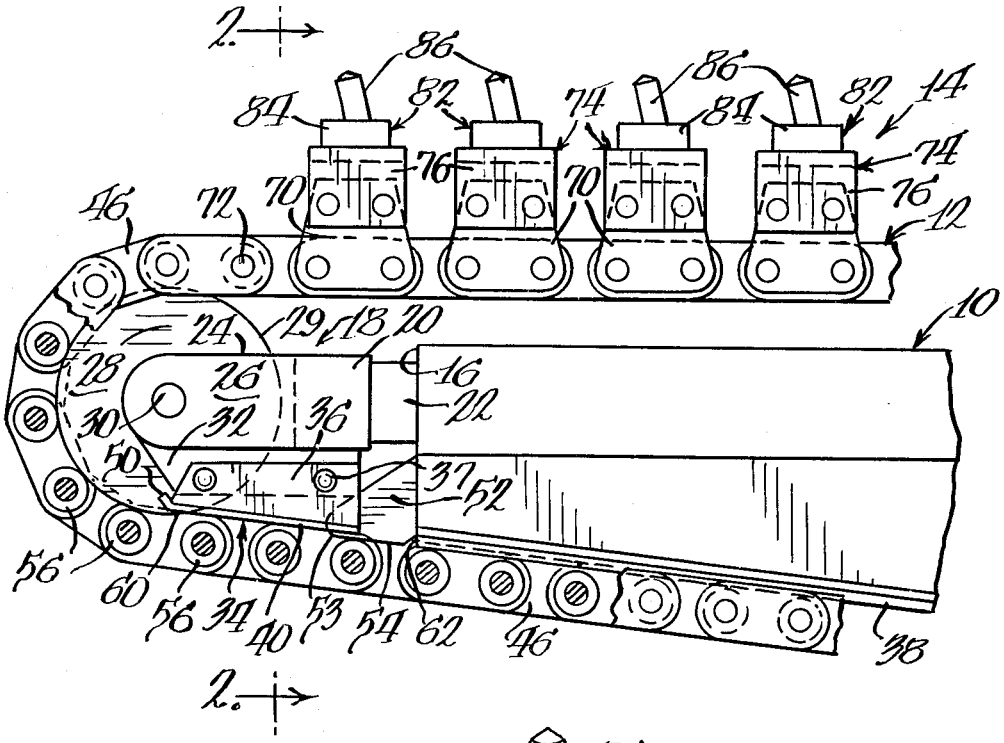
FIG. 1 is a partially fragmented side view of one embodiment of the present invention showing the outer end of a boom having extendable boom end means supporting an idler pulley.
Figure 1:
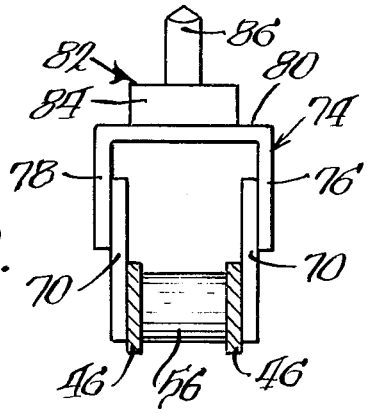

While this invention is susceptible of embodiment in many different forms, there is shown in the drawings and will herein be described in detail a preferred embodiment of the invention with the understanding that the present disclosure is to be considered as an exemplification of the principles of the invention and does not intend to limit the invention to the embodiment illustrated.

FIG. 1 of the drawings shows the outer portion of a boom 10 carrying a chain 12 which is equipped with cutter bit assemblies 14. The boom is provided on its outer end 16 with extendable boom end means 18. The extendable boom end means 18 comprises an inner portion 20 which is resiliently and extendably supported on extendable boom end mount 22 which is telescoped into an opening in outer end 16 of boom 10. Suitable adjusting means (not shown) may be provided between boom end means 18 and boom 10. Shock absorbing means in the form of a compression spring may be interposed between boom 10 and boom end means 18 to allow boom end means 18 to move in and out with respect to boom 10 to absorb shock applied thereto by chain 12.

The outer portion 24 of extendable boom end means 18 includes two side arms 26. Idler pulley 28 having circumferential surface 29 is rotatably disposed between the two side arms and is supported by roller pin 30. The two side arms are spaced apart a distance sufficient to allow the idler pulley to rotate freely therebetween, e.g., a distance greater than the thickness of the idler pulley. Each side arm 26 of the extendable boom end means 18 also includes a lower portion 32.

Chain 12 is carried on boom 10 in sliding engagement with upper and lower surfaces 37 and 38 and in rotating engagement with circumferential surface 29 of idler pulley 28. Chain 12 may be driven by conventional means, such as by a sprocket at or near the inner end of the boom (not shown).

Skid shoe means comprising a pair of skid shoes 34 are mounted on lower portion 32 of side arm 26. Each skid shoe 34 comprises an upper support plate 36 which is connected to the lower portion 32 of the side arm 26 of the extendable boom end 18 by bolts 37 and its lower edge is generally parallel to the lower surface 38 of boom 10. Shoe soles 40 are secured on the lower edges of the upper support plate 36 so that the outer surfaces 42 of the shoe soles are substantially coplanar with the lower surface 38 of boom 10. Skid shoes 34 are separated by distance greater than the thickness or axial dimension of idler pulley 28, but as can be seen from FIG. 2, the separation of shoe soles 40 of the skid shoes is less than the distance between links 46 of the digging chain. In this manner, the inner edges of the links 46 of digging chain 12 may be in sliding engagement with the shoe soles 40 of the skid shoes 34 when the chain is used for digging. In the preferred embodiment, the shoe sole of the skid shoe is generally arcuate and curved away from the links of the chain in the vicinity of its outer end 50 to facilitate sliding of the links of the chain over the skid shoes and also to prevent the chains from snagging on the outer end 50 of the shoe sole.

Figure 2:
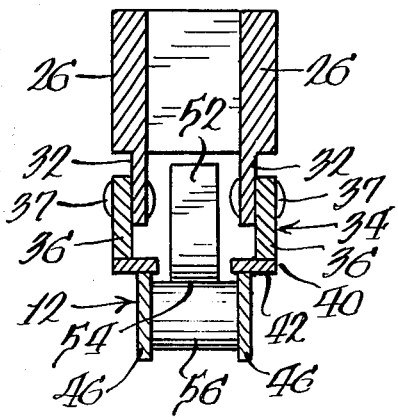
FIG. 2 is a cross-sectional view taken through line 2—2 of the embodiment shown in FIG. 1, and shows the relationship of the skid shoe and nose piece to the chain.

Nose piece 52 is disposed on the lower portion of the outer end 16 of boom 10 and is preferably removably secured by bolts (not shown). Nose piece 52 has a lower surface 54 which is generally parallel to the lower surface of the boom and is adapted to engage rollers 56 of the digging chain 12 when the sidebars of the chain are in engaging the skid shoe soles. The end portion 53 of nose piece 52 is arcuate to facilitate movement of the chain rollers over it and to prevent the rollers from snagging on any sharp edges that might otherwise be present. FIG. 2, which is a cross-sectional view taken along line 2—2 of FIG. 1, shows the general relationship of nose piece 52, chain 12 and skid shoes 34. As is seen from this drawing, the skid shoes are substantially L-shaped in cross section with the soles 40 of the skid shoes 34 being substantially wider than the upper surfaces of the links 46 of chain 12. This arrangement allows for some leeway in the lateral placement of the chain on the skid shoes. Nose piece 52 lies approximately equidistant from each of the soles 40 of skid shoes 34 and is positioned to contact rollers 56 of chain 12 when the upper surfaces of links 46 are in contact with the soles 40 of skid shoes 34.

Referring back to FIG. 1, it is seen that the outer portion of the nose piece 52 falls between skid shoes 34 when the extendable boom end 18 is in its normal position. Thus, if extendable boom end means 18 is extended by the length of the overlap, the chain is supported substantially along substantially the entire portion that lies between the lower tangential point of last contact 60 between chain 12 and idler pulley 28 and the lower outer corner 62 of boom 10.

As discussed previously, chain 12 includes links 46 which are connected by pins 72 which support rollers 56. Chain 12 also has a plurality of cutter bit assemblies 14. Each cutter bit assembly is secured to the chain by adapter links 70 which are secured to the chain by pins 72 which connect the links and rollers of the chain. Adapter links 70 are secured to cutter block 74, which is generally U-shaped and has sides 76 and 78 and top 80. Cutter bits 82 include base portion 84 and bits 86 which may have sharpened ends to facilitate cutting hard earthen material.

With arrangement described above, all of the wear on the boom by the chain takes place on the skid shoes and the nose piece, which are readily removed and replaced at a minimum cost, thereby increasing the service life of the boom.

What is claimed is:

1. Excavating apparatus comprising: a boom adapted to carry a digging chain, the boom having an upper surface, a lower surface, an inner end and an outer end, the upper surface and lower surface adapted to slidably engage the chain, the digging chain including links connected by pins which support rollers, the links having inner surfaces adapted to slidably engage at least one of said upper and lower surfaces of the boom; an idler pulley having a circumferential surface rotatably mounted on the outer portion of the boom, the circumferential surface of the idler pulley adapted to engage the chain; skid shoe means disposed between the idler pulley and the outer end of the boom for slidably engaging and supporting the links of the chain between the idler pulley and the lower surface of the boom, the skid shoe means defining a support surface that is substantially coplanar with the lower surface of the boom; a nose piece mounted on the outer end of the boom, the nose piece having a lower surface generally parallel to the lower surface of the boom and adapted to engage the digging chain rollers when the links of the chain are engaging the skid shoe means.

2. Excavating apparatus of claim 1 which further includes extendable boom end means on said outer end of said boom for adjusting tension of the chain and absorbing shock during digging, said boom end means having an inner portion and an outer portion, the inner portion extendably mounted on the outer end of the boom; said extendable boom end means including a pair of spaced apart side arms adapted at a position near their outer ends to rotatably support the idler pulley on its axis, the length of the side arms measured from the position supporting the idler pulley being at least greater than the radial dimension of the idler pulley, each of the side arms including a lower portion extending downwardly therefrom with said skid shoe means supported on said lower portion.

3. Excavating apparatus of claim 2 wherein the skid shoe means comprises a pair of skid shoes, each skid shoe comprising an upper support plate with a lower edge, the support plate adapted to be connected to the lower portion of the extendable boom end so that its lower edge is generally parallel to the lower surface of the boom, a shoe sole having an inner surface and outer surface and disposed on the lower edge of the upper support plate so that its outer surface is substantially coplanar with the lower surface of the boom, each skid shoe separated by a distance greater than the axial dimension of the idler pulley but less than the distance between the links of the digging chain so that the inner surfaces of the links may be in sliding engagement with the shoe soles.

4. Excavating apparatus of claim 3 wherein the outer end of each skid sole is generally arcuate to facilitate sliding of the links of the chain.

5. Excavating apparatus of claim 3 wherein the outer portion of the nose piece lies between the two skid shoes in the region of the inner ends of the skid shoes, the end of the nose piece being arcuate to facilitate movement of the chain rollers thereover.

* * * * *